US009850775B2

(12) United States Patent
Pietrobon et al.

(10) Patent No.: US 9,850,775 B2
(45) Date of Patent: Dec. 26, 2017

(54) TURBINE SHROUD SEGMENT SEALING

(71) Applicant: Pratt & Whitney Canada Corp., Longueuil (CA)

(72) Inventors: John Pietrobon, Outremont (CA); Remy Synnott, St-Jean-sur-Richelieu (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 5 days.

(21) Appl. No.: 15/338,840

(22) Filed: Oct. 31, 2016

(65) Prior Publication Data

US 2017/0044919 A1 Feb. 16, 2017

Related U.S. Application Data

(63) Continuation of application No. 13/799,212, filed on Mar. 13, 2013, now Pat. No. 9,500,095.

(51) Int. Cl.

| | |
|---|---|
| ***F01D 11/08*** | (2006.01) |
| ***F01D 25/12*** | (2006.01) |
| ***F01D 9/04*** | (2006.01) |
| ***F01D 11/24*** | (2006.01) |

(52) U.S. Cl.

CPC ..... *F01D 11/08* (2013.01); *F01D 9/041* (2013.01); *F01D 11/24* (2013.01); *F01D 25/12* (2013.01); *F05D 2220/32* (2013.01); *F05D 2240/30* (2013.01); *F05D 2250/141* (2013.01); *F05D 2250/191* (2013.01); *F05D 2250/231* (2013.01); *F05D 2260/201* (2013.01)

(58) Field of Classification Search

CPC ..... F01D 11/08; F01D 11/12; F01D 11/122; F01D 11/125; F01D 11/127

USPC ..... 415/170.1, 173.1, 173.4, 174.4

See application file for complete search history.

(56) References Cited

U.S. PATENT DOCUMENTS

| | | | |
|---|---|---|---|
| 4,365,933 | A | 12/1982 | Langer et al. |
| 4,621,976 | A | 11/1986 | Marshall et al. |
| 5,482,433 | A | 1/1996 | Norris et al. |
| 5,868,398 | A | 2/1999 | Maier et al. |
| 5,988,975 | A | 11/1999 | Pizzi |
| 6,910,854 | B2 | 6/2005 | Joslin |
| 7,306,428 | B2 | 12/2007 | Schiebold et al. |
| 8,206,092 | B2 | 6/2012 | Tholen et al. |
| 2002/0187040 | A1 | 12/2002 | Predmore |
| 2006/0082074 | A1 | 4/2006 | Synnott et al. |
| 2009/0220331 | A1 | 9/2009 | Shapiro et al. |
| 2009/0269190 | A1 | 10/2009 | Wunderlich et al. |
| 2010/0237571 | A1 | 9/2010 | Durocher et al. |

(Continued)

*Primary Examiner* — Mark Laurenzi
*Assistant Examiner* — Mickey France
(74) *Attorney, Agent, or Firm* — Norton Rose Fulbright Canada LLP

(57) ABSTRACT

An integrated shroud structure surrounds a circumferential array of stator vanes and a circumferential array of rotor blades of a gas turbine engine. The shroud structure includes a plurality of vane shroud segments and a plurality of blade shroud segments. The blade shroud segments integrally extend downstream from the vane shroud segments and each pair of circumferentially adjacent blade shroud segments defines an inter-segment gap. At least one slot extends axially from a location downstream of the vane shroud segments to an aft end of the blade shroud segment. The inter-segment gaps and slots are sealed by a sealing band mounted around the full circumference of the integrated shroud structure.

16 Claims, 5 Drawing Sheets

(56) References Cited

U.S. PATENT DOCUMENTS

| | | | |
|---|---|---|---|
| 2013/0156556 | A1 | 6/2013 | Franks et al. |
| 2013/0206739 | A1 | 8/2013 | Reed et al. |

TURBINE SHROUD SEGMENT SEALING

RELATED APPLICATIONS

This application is a continuation of U.S. Pat. No. 9,500,095 issued on Nov. 22, 2016, the content of which is hereby incorporated by reference.

TECHNICAL FIELD

The application relates generally to the field of gas turbine engines, and more particularly, to shroud segments for surrounding the blades of gas turbine engine rotors.

BACKGROUND OF THE ART

The turbine shrouds surrounding turbine rotors are normally segmented in the circumferential direction to allow for thermal expansion. Being exposed to very hot combustion gasses, the turbine shrouds usually need to be cooled. Since flowing coolant through a shroud assembly diminishes overall engine efficiency, it is desirable to minimize cooling flow consumption without degrading shroud segment durability. Individual feather seals are typically installed in confronting slots defined in the end walls of circumferentially adjacent turbine shroud segments to prevent undesirable cooling flow leakage at the inter-segment gaps between adjacent shroud segments. While such feather seal arrangements generally provide adequate inter-segment sealing, there is a continued need for alternative sealing and cooling shroud arrangements.

SUMMARY

In one aspect, there is provided a shroud structure integrated to a circumferential array of stator vanes for surrounding a circumferential array of rotor blades of a gas turbine engine, the circumferential array of stator vanes positioned axially upstream of the circumferential array of rotor blades, the shroud structure comprising: a plurality of blade shroud segments disposed circumferentially one adjacent to another and configured to surround the circumferential array of rotor blades, the blade shroud segments extending integrally from the circumferential array of stator vanes, each pair of circumferentially adjacent blade shroud segments defining an inter-segment gap, at least one of the plurality of blade shroud segments having a radially inner gas path surface and an opposed radially outer surface and at least one slot extending axially from a location downstream of the circumferential array of stator vanes to a downstream end of the at least one of the plurality of the blade shroud segments between the radially inner gas path surface and the opposed radially outer surface thereof; and a sealing band mounted around the radially outer surface of the blade shroud segments and extending across the inter-segment gaps and the at least one slot around the full circumference of the integrated shroud structure.

In a second aspect, there is provided a shroud assembly surrounding stator vanes and rotor blades of a gas turbine engine, the shroud assembly comprising: a plurality of integrated shroud structures disposed circumferentially one adjacent to another to form a circumferentially segmented shroud ring, the segmented shroud ring comprising: a plurality of vane shroud segments; and a plurality of blade shroud segments integrally extending from the plurality of vane shroud segments, each one of the blade shroud segments having a body axially defined from a forward end to an aft end in a direction from an upstream position to a downstream position of a gas flow passing through the integral shroud assembly, and being circumferentially defined between opposite first and second lateral sides, said body including a platform having a radially inner gas path surface and an opposed radially outer back surface, and forward and aft arms extending from the back surface of the platform, said forward and aft arms being axially spaced-apart from each other, at least one slot extending axially from the aft arm towards the forward arm and between the radially inner gas path surface and the opposed radially outer surface thereof; and a sealing band mounted between the forward and aft arms on the back surface of the blade shroud segments, the sealing band encircling the segmented blade shroud ring and circumferentially spanning all the inter-segment gaps and at least partially axially covering the at least one slot.

In a third aspect, there is provided a method for sealing and cooling a circumferentially segmented integrated shroud structure, the shroud structure including a segmented blade shroud ring integrally extending from a segmented vane shroud ring in a gas turbine engine, the method comprising surrounding the segmented blade shroud ring with a sealing band configured to fully encircle the segmented blade shroud ring; surrounding at least a portion of axially extending slots defined in the segmented blade shroud ring with the sealing band; forming a pressurized air plenum around the sealing band for urging the sealing band in sealing engagement against a radially outer surface of the segmented blade shroud ring; and providing impingement jet holes in the sealing band to allow some of the pressurized air in the plenum to impinge upon a radially outer surface of the segmented blade shroud ring.

DESCRIPTION OF THE DRAWINGS

Reference is now made to the accompanying figures, in which.

DETAILED DESCRIPTION

Figure 1:
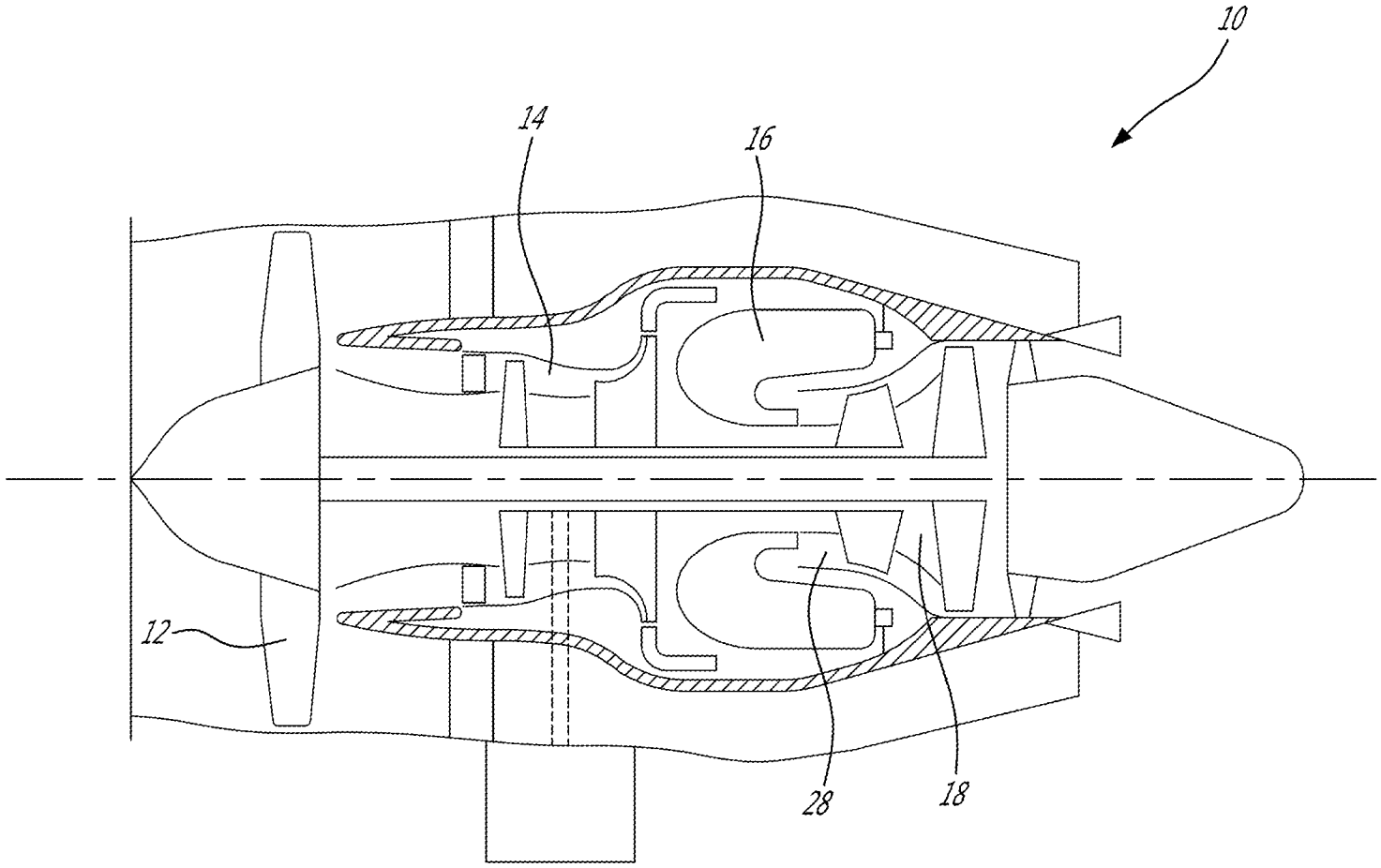
FIG. 1 is a schematic cross-section view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
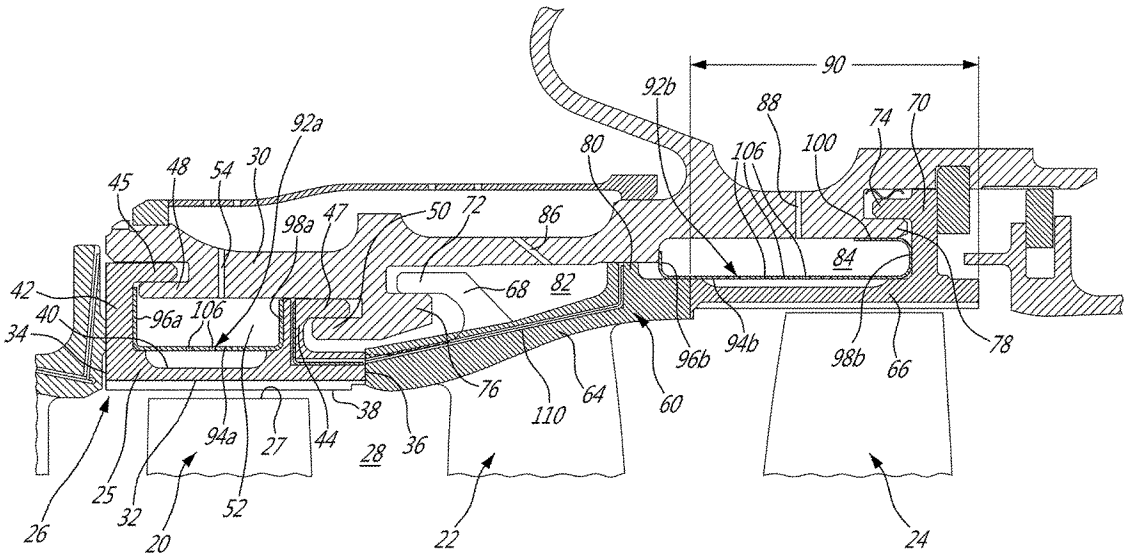
FIG. 2 is a cross-section view of a portion of the turbine section of the gas turbine engine shown in FIG. 1 and illustrating first and second integrated impingement baffle and shroud seals respectively surrounding a circumferentially segmented turbine shroud and a segmented turbine shroud integrated to an upstream segmented vane ring.

Referring to FIG. 2, it can be observed that the turbine section 18 of the engine 10 may include a number of turbine stages. More particularly, FIG. 2 illustrates a first stage of turbine rotor blades 20 axially followed by a second stage of stationary turbine vanes 22 disposed for channelling the combustion gases to an associated second stage of turbine blades 24 mounted for rotation about the engine centerline.

Figure 5:
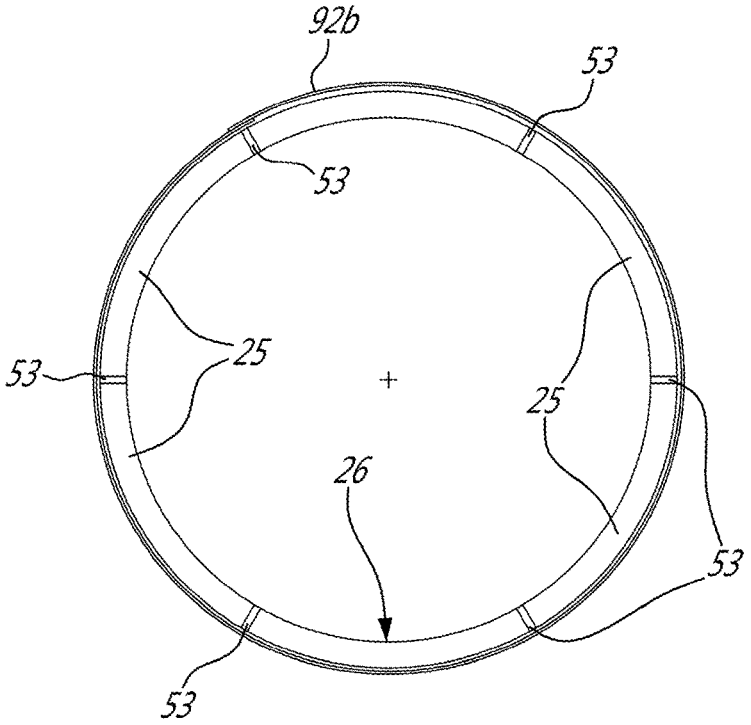
FIG. 5 is a schematic end view illustrating a sealing band mounted about a circumferentially segment shroud ring for sealing the inter-segment gaps.

Surrounding the first stage of turbine blades 20 is a stationary shroud ring 26. The shroud ring 26 is circumferentially segmented to accommodate differential thermal expansion during operation. Accordingly, the shroud ring 26 may be composed of a plurality of circumferentially adjoining shroud segments 25 (see FIG. 5) concentrically arranged around the periphery of the turbine blade tips 27 so as to define a portion of the radially outer boundary of the engine gas path 28. The shroud segments 25 may be individually supported and located within the engine by an outer housing support structure 30 so as to collectively form a continuous shroud ring about the turbine blades 20. As shown in FIG. 2, each shroud segment 25 comprises an arcuate platform 32 extending axially from a forward end 34 to an aft end 36 and circumferentially between first and second opposed ends. The platform 32 has a radially inner gas path surface 38 and an opposed radially outer back surface 40. Axially spaced-apart forward and aft arms 42, 44 extend radially outwardly from the back surface 40 of each segment. The arms 42, 44 are provided with respective axially projecting distal hooks or rail portions 45, 47 for engagement with corresponding mounting flange projections 48, 50 on the surrounding support structure 30. A shroud plenum 52 is defined between the arms 42, 44 and the radially outer back surface 40 of the platform 32 for receiving pressurized cooling air from a cooling air source, for example bleed air from the compressor 14. A feed hole 54 may be defined in the support structure 30 for directing the cooling air in the plenum 52. As well known, once the shroud ring 26 is assembled, small circumferential inter-segment gaps 53 (FIG. 5) exist between the first and second circumferential ends of adjacent shroud segments 25. As will be seen hereafter, a sealing arrangement is provided to limit cooling air leakage into the engine gas path through the inter-segment gaps.

Figure 4:
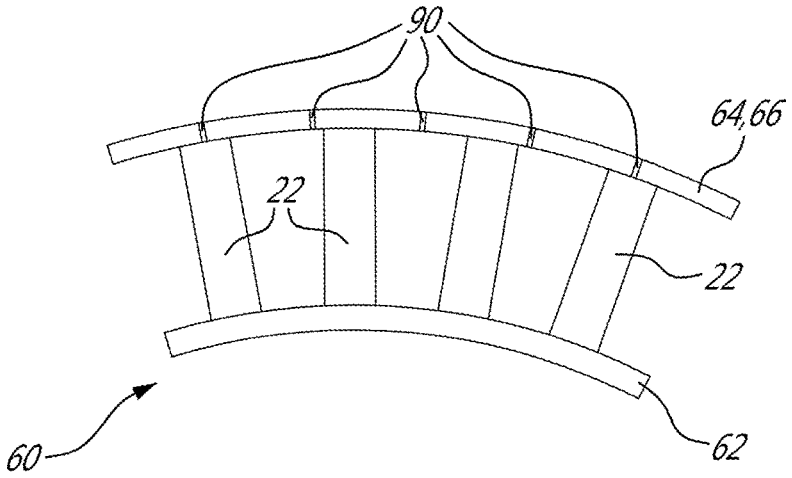
FIG. 4 is a rear end view of a split turbine shroud segment integrated to a turbine vane segment.

As shown in FIGS. 2 and 4, the second stage of turbine vanes 22 is also typically segmented. Each vane segment 60 comprises at least one vane 22 extending radially between inner and outer vane shroud segments 62, 64 that defines the radial flow boundaries for the annular stream of hot gases flowing through the vane ring. In the example illustrated in FIG. 4, each vane segment 60 is cast or otherwise suitably manufactured with four circumferentially spaced-apart vanes 22. Typically, for a given turbine stage, the blade shroud segments are separate from the vane segments. However, as shown in FIG. 2, it is herein proposed to combine the vane segments 60 and the blade shroud segments into integral parts. More particularly, each vane segment 60 may be cast with a shroud blade portion 66 extending rearwardly from the outer vane shroud 64. The integrated structure may be provided with a forward support arm 68 extending radially outwardly from the vane shroud 64 and an aft support arm 70 extending radially outwardly from the blade shroud portion 66. The forward and aft support arms 68, 70 are provided with respective axially projecting distal hooks or rail portions 72, 74 for engagement with corresponding mounting flange projections 76, 78 on the surrounding support structure 30. An intermediate ridge 80 may project radially outwardly from the integrated vane and blade shroud to allow for the formation of separate cooling air plenums 82, 84 for the vane and blade shroud portions 64, 66. The ridge 80 is configured for radially abutting a radially inner surface of the surrounding support structure 30. Separate feed holes 86, 88 may be provided in the support structure 30 for individually feeding the plenums 82, 84 with cooling air.

The blade shroud portion 66 of each integrated segment will be classified for different rotor tip diameters. For enhance tip clearance control, multiple blades shroud segments may be incorporated in the same cast vane segment. The integrated approach has several benefits including: less part count, cost and weight reduction, reduced secondary air leakage and smoother gas path, and durability improvement as the TSC is not directly exposed to gas path conditions. Also the vane and shroud segment parts are designed to the same life target, so they should be replaced at overhaul.

Referring concurrently to FIGS. 2 and 4, it can be observed that the blade shroud portion 66 of each integrated segment may be slotted either mechanically (i.e. EDM, grinding, etc.) or cast-in, to minimize thermal stress and blade shroud uncurling. The number of slots 90 depends on static structures requirements (uncurling, thermal stress, etc.). In the embodiment illustrated in FIG. 4, five circumferentially spaced-apart slots 90 are defined in the blade shroud portion 66 of an integrated quad vane segment. As shown in FIG. 2, each slot 90 may extend axially from the aft end of the integrated blade shroud portion to a location upstream of the blades 24 relative to the flow of gases flowing through the engine gas path 28.

As shown in FIG. 2, a sealing band 92*a*, 92*b* may be disposed in each of the plenums 52, 84 to seal all the inter-segment gaps (such as the ones shown at 53 in FIG. 5) around the segmented shroud rings and, thus, limit cooling air leakage from the plenums 52, 84 into the engine gas path 28. Each sealing band 92*a*, 92*b* is configured to be fitted in sealing engagement with the boundary surfaces of the associated plenum. The pressurized air directed in the plenums 52, 84 may be used to urge the sealing bands 92*a*, 92*b* in proper sealing engagement with the plenum boundary surfaces. The first sealing band 92*a* has a generally C-shaped cross-section including an annular base 94*a* and forward and aft radially outwardly extending annular sealing faces 96*a*, 98*a*. The forward and aft sealing faces 96*a*, 98*a* are urged by the pressurized air in uniform sealing contact with the forward and aft arms 42, 44. Likewise, the annular base 94*a* is urged in sealing contact with the radially outer surface of the circumferentially segmented shroud ring 26. Similarly, the second sealing band 92*b* has an annular base 94*b* and forward and aft annular sealing faces 96*b*, 98*b*. The aft sealing face 98*b* may have an axially forwardly bent end portion 100 for engagement with a radially inner surface of the support structure 30 for sealing the aft hook interface between the shroud and support structure. The forward annular face 96*b* of the sealing band 92*b* is urged in sealing engagement against a corresponding axially facing surface of the support structure 30. The aft annular sealing face 98*b* is urged in sealing engagement with the aft arm 70. The annular base 94*b* is urged in sealing engagement with the radially outer surface of the blade shroud portions 66 of the segmented blade shroud ring.

Figure 6:
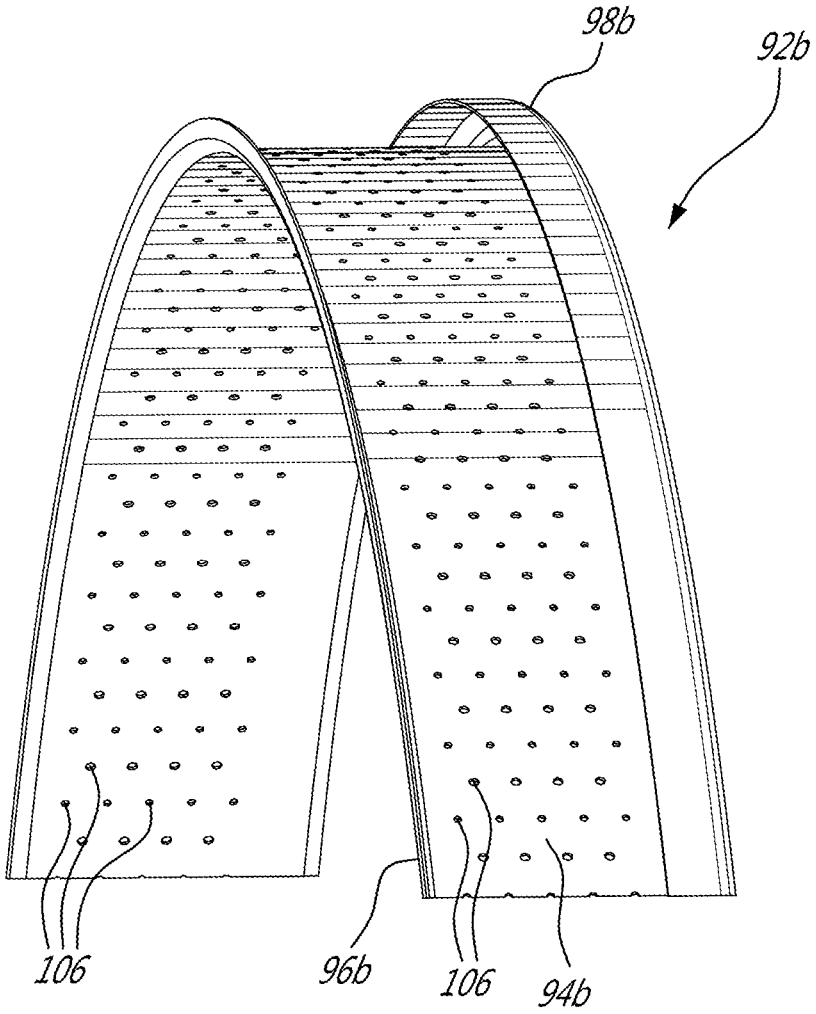
FIG. 6 is a isometric view of a portion of the inter-segment sealing band shown in FIG. 5.

Each sealing band 92*a*, 92*b* covers 360 degrees and, thus, extends across the inter-segment gaps around the full circumference of the associated segmented shroud. The second sealing band 92*b* also seals the portion of the slots 90 extending forwardly from the aft support arm 74. Each sealing band 92*a*, 92*b* may be provided in the form of a full ring, a single split ring with overlapping end portions (FIG. 3) or a single split ring with a butt joint. Sheet metal may be used to form the sealing bands. Impingement jet holes 106 (FIGS. 2 and 6) may be defined in the sealing bands 92*a*, 92*b* to allow the same to also act as impingement baffles for cooling the shroud segments. A portion of the air directed in the plenums 52, 84 can thus flow through the impingement jet holes 106 for impinging upon the underlying radially outer surface of the segmented shroud rings.

Figure 3:
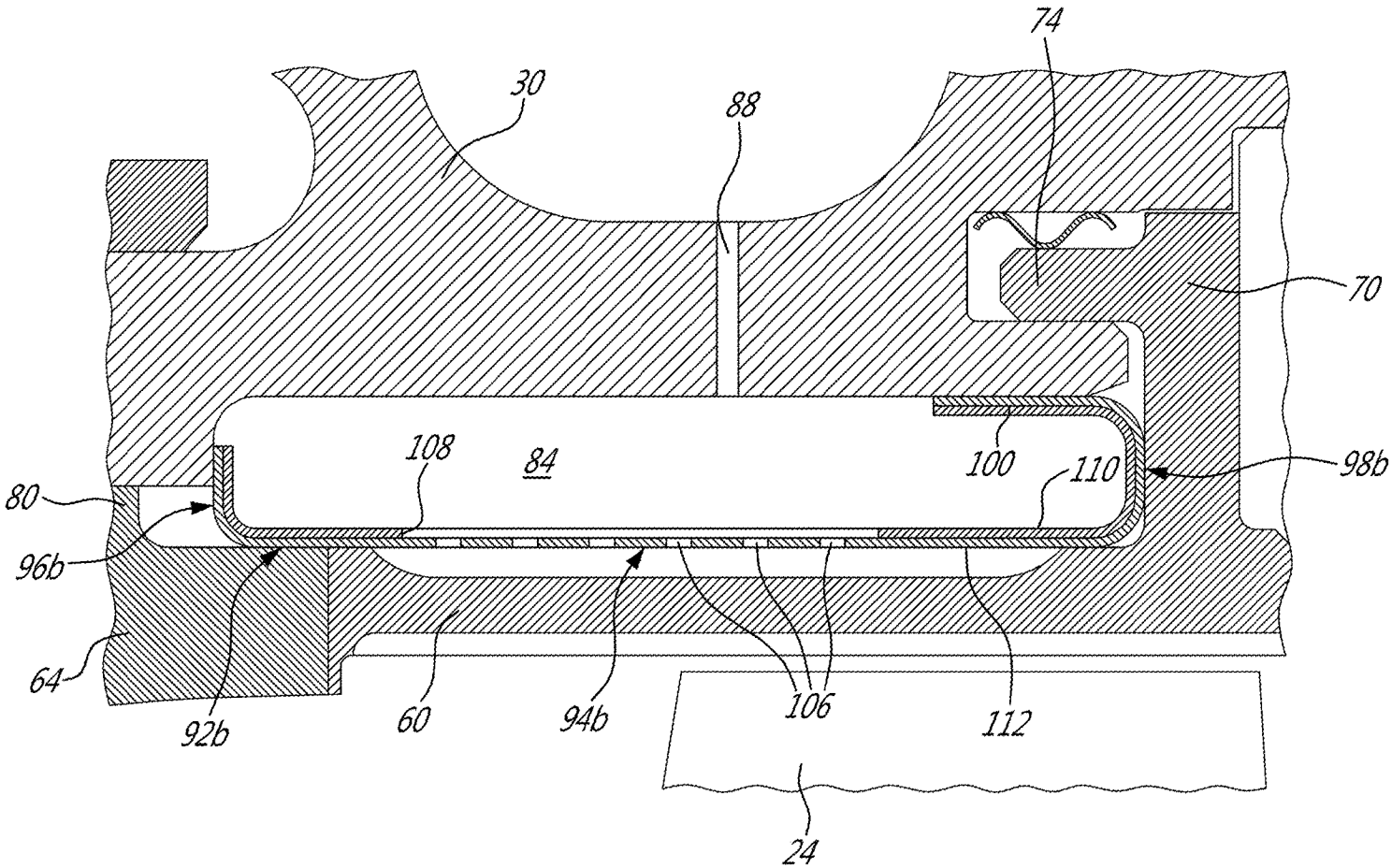
FIG. 3 is an enlarged cross-section view illustrating the integrated impingement baffle and shroud seal surrounding the full periphery of a circumferentially segmented turbine blade shroud.

As shown in FIG. 3, if the sealing bands 92*a*, 92*b* are provided with overlapping end portions, a window opening 108 may be defined in the radially outer base layer 110 in order not to block the underlying impingement jets 106 defined in the radially inner base layer 112. The window opening 108 may be oversized to ensure proper registry between the window opening 108 and the underlying impingement jet holes 106 when the overlapping end portions of the sealing band 92*a*, 92*b* slide relative to each other to accommodate thermal growth during engine operation. The use of sealing bands 92*a*, 92*b* to seal the inter-segment gaps instead of conventional feather seals result in less part count. It also provides cost reduction (eliminate feather seal slots and feather seals). It also contributes to reduce the assembly time. Finally, it may result in reduced secondary air leakage.

It is noted that conventional feather seals 110 (FIG. 2) may still be used to prevent the air directed into the plenum 82 surrounding the second stage of vanes 22 to leak into the engine gas path 28 via the inter-segment gaps in the shroud vane portion 64 of the integrated vane-blade shroud segments.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A shroud structure integrally cast with a circumferential array of stator vanes for surrounding a circumferential array of rotor blades of a gas turbine engine, the circumferential array of stator vanes positioned axially upstream of the circumferential array of rotor blades, the shroud structure comprising:

a plurality of blade shroud segments disposed circumferentially one adjacent to another and configured to surround the circumferential array of rotor blades, the blade shroud segments extending integrally from the circumferential array of stator vanes, each pair of circumferentially adjacent blade shroud segments defining an inter-segment gap, at least one of the plurality of blade shroud segments having a radially inner gas path surface and an opposed radially outer surface and at least one slot extending axially from a location downstream of the circumferential array of stator vanes to a downstream end of the at least one of the plurality of the blade shroud segments between the radially inner gas path surface and the opposed radially outer surface thereof; and a sealing band mounted around the radially outer surface of the blade shroud segments and extending across the inter-segment gaps and the at least one slot around the full circumference of the integrated shroud structure;

wherein the at least one slot is configured to extend axially upstream of the array of rotor blades, and wherein the at least one slot has a portion thereof that extends axially downstream of the sealing band.

2. The shroud structure as defined in claim 1, wherein impingement holes are defined in the annular sealing band, the impingement holes being in flow communication with a source of cooling air for directing cooling jets against the radially outer surface of the blade shroud segments.

3. The shroud structure as defined in claim 2, wherein the sealing band consists of a single split sheet metal loop.

4. The shroud structure as defined in in claim 3, the single split sheet metal loop has opposed overlapping end portions adapted to circumferentially slide one over the other.

5. The shroud structure as defined in claim 4, wherein the opposed overlapping end portions includes a radially outer end portion and a radially inner end portion, wherein the radially outer end portion has a window opening defined therein in registry with a plurality of the underlying impingement holes defined in the radially inner end portion of the single split sheet metal loop.

6. The shroud structure as defined in claim 1, wherein the sealing band consists of a selected one of a circumferentially continuous ring, a split ring with opposed overlapping end portions, and a split ring with a butt joint.

7. The shroud structure as defined in claim 1, wherein the at least one slot extends through a whole length of the blade shroud segment.

8. The shroud structure as defined in claim 1, wherein the at least one slot includes at least two circumferentially spaced-apart slots.

9. The shroud structure as defined in claim 1, wherein axially spaced-apart forward and aft arms extend from the radially outer surface of each one of the blade shroud segments, and wherein the sealing band is disposed between said forward and aft arms.

10. The shroud structure as defined in claim 1, wherein the sealing band has a generally radially outwardly open C-shaped cross-section.

11. A shroud assembly surrounding stator vanes and rotor blades of a gas turbine engine, the shroud assembly comprising:

a plurality of shroud structures disposed circumferentially one adjacent to another to form a circumferentially segmented shroud ring, the segmented shroud ring comprising:

a plurality of vane shroud segments; and a plurality of blade shroud segments, the blade shroud segments and the vane shroud segments being of unitary construction, each one of the blade shroud segments having a body axially defined from a forward end to an aft end in a direction from an upstream position to a downstream position of a gas flow passing through the integral shroud assembly, and being circumferentially defined between opposite first and second lateral sides, said body including a platform having a radially inner gas path surface and an opposed radially outer back surface, and forward and aft arms extending from the back surface of the platform, said forward and aft arms being axially spaced-apart from each other, at least one slot extending axially from the aft arm towards the forward arm and between the radially inner gas path surface and the opposed radially outer surface thereof; and a sealing band mounted between the forward and aft arms on the back surface of the blade shroud segments, the sealing band encircling the segmented blade shroud ring and circumferentially spanning all the inter-segment gaps and at least partially axially covering the at least one slot;

wherein the at least one slot has a portion thereof that extends axially downstream of the sealing band.

12. The shroud assembly as defined in claim 11, wherein the sealing band has a plurality of impingement holes defined therethrough for directing cooling air jets against the radially outer back surface of the platform of each of the blade shroud segments.

13. The shroud assembly as defined in claim 11, wherein the at least one slot extends axially through the platform.

14. A method for sealing and cooling a circumferentially segmented shroud structure, the shroud structure including a segmented blade shroud ring and a segmented vane shroud ring in a gas turbine engine, the segmented blade shroud ring comprising blade shroud segments, the segmented vane shroud ring comprising vane shroud segments, the blade shroud segments and the vane shroud ring segments being of unitary construction, the method comprising:

surrounding the segmented blade shroud ring with a sealing band configured to fully encircle the segmented blade shroud ring;

surrounding at least a portion of axially extending slots defined in the segmented blade shroud ring with the sealing band, the axially extending slots having a portion thereof extending axially downstream of the sealing band;

forming a pressurized air plenum around the sealing band for urging the sealing band in sealing engagement against a radially outer surface of the segmented blade shroud ring; and providing impingement jet holes in the sealing band to allow some of the pressurized air in the plenum to impinge upon a radially outer surface of the segmented blade shroud ring.

15. The method as defined in claim 14, wherein the sealing band is a split ring having overlapping end portions, the overlapping end portions including radially inner and outer layers, and wherein the method further comprises:

registering a window opening in the radially outer layer with a plurality of the impingement jet holes in the radially inner layer.

16. The method as defined in claim 14, wherein the surrounding step comprises mounting the sealing band between axially spaced-apart arms projecting radially outwardly from the radially outer surface of the segmented blade shroud ring.

* * * * *